US010159138B2

(12) United States Patent
Van Der Brug

(10) Patent No.: US 10,159,138 B2
(45) Date of Patent: Dec. 18, 2018

(54) GROUPING LIGHTING UNITS

(71) Applicant: PHILIPS LIGHTING HOLDING B.V., Eindhoven (NL)

(72) Inventor: Willem Peter Van Der Brug, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/114,397

(22) PCT Filed: Jan. 21, 2015

(86) PCT No.: PCT/EP2015/051041
§ 371 (c)(1),
(2) Date: Jul. 26, 2016

(87) PCT Pub. No.: WO2015/113871
PCT Pub. Date: Aug. 6, 2015

(65) Prior Publication Data

US 2016/0345413 A1 Nov. 24, 2016

(30) Foreign Application Priority Data

Jan. 30, 2014 (EP) ..... 14153243

(51) Int. Cl.
*H05B 37/02* (2006.01)
*F21S 8/08* (2006.01)
(Continued)

(52) U.S. Cl.
CPC ..... *H05B 37/0263* (2013.01); *F21S 8/086* (2013.01); *F21V 23/003* (2013.01); *H05B 37/0245* (2013.01); *F21W 2131/103* (2013.01)

(58) Field of Classification Search
CPC . H05B 37/0263; H05B 37/0245; F21S 8/086; F21V 23/003
See application file for complete search history.

(56) References Cited

U.S. PATENT DOCUMENTS

2009/0026966 A1 1/2009 Budde et al.
2009/0103306 A1* 4/2009 Hargraves ..... F21L 14/00 362/294
(Continued)

FOREIGN PATENT DOCUMENTS

CN 101137260 A 3/2008
CN 102413616 A 4/2012
(Continued)

OTHER PUBLICATIONS

Eileen Patton, EIC 2800 Search Report, dated Jun. 2, 2017, Scientific and Technical Information Center.*

*Primary Examiner* — Dedei K Hammond
*Assistant Examiner* — Raymond R Chai

(57) ABSTRACT

A method of configuring a plurality of installed lighting units (110) comprises determining that a first installed lighting unit (110) should remain a member of a first logical group, and that a second installed lighting unit (110) should switch to a second logical group. The method further comprises interrupting a supply of electric power to the first installed lighting unit (110), e.g. via a suitable an interrupter (310), whereby the first installed lighting unit (110) is incapable of receiving a command from a controller of at least the first and second installed lighting units. The method further comprises broadcasting, from the controller, to at least the first and second installed lighting units (110), a command arranged to cause any suitable lighting unit (110) which receives it to join the second logical group, thereby causing the second installed lighting unit (110) to switch to the second logical group. The method further comprises resuming the supply of electric power to the first installed lighting unit (110) whereby it becomes operable to receive and react to commands from the controller.

11 Claims, 3 Drawing Sheets

(51) Int. Cl.
*F21V 23/00* (2015.01)
*F21W 131/103* (2006.01)

(56) References Cited

U.S. PATENT DOCUMENTS

| | | | | |
|---|---|---|---|---|
| 2009/0175038 | A1 | 7/2009 | Rooymans | |
| 2009/0222223 | A1 | 9/2009 | Walters et al. | |
| 2010/0029268 | A1 | 2/2010 | Myer et al. | |
| 2010/0134042 | A1 | 6/2010 | Willaert | |
| 2010/0164386 | A1 | 7/2010 | You | |
| 2011/0068900 | A1 | 3/2011 | Billig et al. | |
| 2011/0175553 | A1* | 7/2011 | Sampsell ..... | H05B 37/0245 315/312 |
| 2012/0014101 | A1 | 1/2012 | Rami et al. | |
| 2013/0093332 | A1 | 4/2013 | Lee et al. | |
| 2013/0314001 | A1 | 11/2013 | Liu et al. | |
| 2015/0141005 | A1* | 5/2015 | Suryavanshi ..... | H04L 67/125 455/434 |

FOREIGN PATENT DOCUMENTS

| | | | |
|---|---|---|---|
| WO | 2013036013 | A2 | 3/2013 |
| WO | 2013093914 | A1 | 6/2013 |

* cited by examiner

GROUPING LIGHTING UNITS

CROSS-REFERENCE TO PRIOR APPLICATIONS

This application is the U.S. National Phase application under 35 U.S.C. § 371 of International Application No. PCT/EP2015/051041, filed on Jan. 21, 2015, which claims the benefit of European Patent Application No. 14153243.2, filed on Jan. 30, 2014. These applications are hereby incorporated by reference herein.

FIELD OF THE INVENTION

The present disclosure relates generally to lighting units, lighting fixtures and lighting networks. More particularly, the present disclosure relates to assigning lighting units of a lighting network to respective a logical group.

BACKGROUND OF THE INVENTION

Lighting networks generally comprise several lighting fixtures arranged throughout an environment, in order to illuminate the environment. For example, an outdoor lighting network may comprise hundreds of lighting fixtures installed along roadsides in order to illuminate a road network.

Increasingly, it is becoming desirable that not all of a lighting network's lighting fixtures behave in the same way. For example, an outdoor lighting network may include lighting fixtures at locations in a road network which must be well illuminated during most of the night, e.g. at junctions, crossings, exits and the like, as well as lighting fixtures which for one or more portions of the night can be dimmed-down substantially. Thus it is becoming increasingly desirable to control some of a network's lighting fixtures separately from others of its lighting fixtures.

SUMMARY OF THE INVENTION

The present disclosure contemplates a lighting network comprising a plurality of lighting units, in which each of the lighting units can be assigned to a respective one of at least two logical groups, so that a controller of the network can separately control different groups of lighting units. In such a lighting network, there would be a need for a convenient way to assign each of the lighting units to its logical group.

Accordingly, one aspect of the present invention provides a method of configuring a plurality of installed lighting units. The method may comprise determining that a first installed lighting unit should remain a member of a first logical group, and that a second installed lighting unit should switch to a second logical group. The method may further comprise interrupting a supply of electric power to the first installed lighting unit whereby it is incapable of receiving a command from a controller of at least the first and second installed lighting units. The method may further comprise broadcasting, from the controller, to at least the first and second installed lighting units, a command arranged to cause any suitable lighting unit which receives it to join the second logical group, thereby causing the second installed lighting unit to switch to the second logical group. The method may further comprise resuming the supply of electric power to the first installed lighting unit whereby it becomes operable to receive and react to commands from the controller.

Such a method is straightforward and so may be carried out by relatively unskilled personnel, thereby potentially reducing the costs associated with deploying a lighting network. For instance, the lighting units may be factory-set with a configuration whereby they are members of the first logical group by default. After the lighting units have been installed, a commissioning engineer or other personnel need only determine, e.g. using a lighting plan, any lighting unit which should be switched to the second logical group. Then he or she may interrupt the supply of electric power to the other lighting units (e.g. any lighting unit which should remain in its current logical group), effect said broadcasting and then resume the supply of electric power to the other lighting units. As a result, the lighting units are configured for group control, e.g. in accordance with the lighting plan. Since configuration is done after installation, the installation also is convenient.

In various embodiments, the first installed lighting unit may be mounted on a pole, and interrupting the supply of electric power thereto may comprise reversibly breaking a circuit arranged to provide the supply of electric power to the lighting unit, at an accessible location on or in the pole.

The term "accessible location" is used herein to refer to any location on or in the lighting pole which the average person can reach while standing next to the lighting pole, i.e. without requiring a ladder, crane etc. For example, preferably the accessible location is not more than two meters above the ground. The accessible location may be inside the lighting pole and covered by a removable access panel, for example.

In various embodiments, reversibly breaking the circuit may comprise at least one of: operating a switch at the accessible location; operating a circuit breaker at the accessible location; and removing a fuse at the accessible location.

In various embodiments, the method may further comprise broadcasting, from the controller, to at least the first and second installed lighting units, before interrupting the supply of electric power to the first installed lighting unit, a command arranged to cause any suitable lighting unit which receives it to join the first logical group, thereby causing the first and second installed lighting units to join the first logical group.

In various embodiments, the method may further comprise determining that there is a minority logical group for the plurality of installed lighting units, and selecting the minority logical group as said first logical group. As used herein, a logical group is the minority logical group if it has fewer member lighting units than any other logical group has.

Thus, broadcasting the join-first-group command causes all lighting units which receive it to join the minority logical group. As a result, said interrupting a supply of electric power will be performed in respect of fewer lighting units than would be the case if the first logical group were the majority logical group.

In various embodiments, said broadcasting may comprise broadcasting the command via power line communication.

The first and second installed lighting units, and optionally one or more additional lighting units, may be connected to a common supply of electric power, e.g. a single-phase, two-phase or three-phase supply of AC electric power. Thus, encoding a command in the common supply results in the encoded command being broadcast to all of the lighting units connected thereto. Of course, if the supply of electric power to a given one of the lighting units is interrupted while the command is encoded in the common supply, that lighting unit will not receive the encoded command.

Another aspect of the invention provides a lighting fixture comprising a lighting unit and an interrupter suitable for interrupting a supply of electric power to the lighting unit. The lighting unit may be configured to be a member of a first logical group, receive from the controller a command arranged to cause any suitable lighting unit which receives it to join a second logical group, and switch from the first logical group to the second logical group in response to receiving said command from the controller.

In various embodiments, the interrupter may be suitable for reversibly interrupting a supply of electric power to the respective lighting unit.

As used herein, there term "interrupter" should be interpreted broadly, so as to encompass any structure, device or mechanism suitable for interrupting a supply of electric power.

In various embodiments, the interrupter may be provided at an accessible location on or in the lighting fixture.

In various embodiments, the interrupter may comprise at least one of: a switch; a circuit breaker; and a fuse.

Another aspect of the invention provides a controller for controlling a plurality of lighting units, the controller being operable to broadcast a command arranged to cause any suitable lighting unit which receives it to join a first logical group. The controller may be further operable to broadcast a command arranged to cause any suitable lighting unit which receives it to join a second logical group.

In various embodiments, the controller may be operable to broadcast the command(s) via power line communication.

Another aspect of the invention provides a lighting network comprising such a controller and one or more of the lighting fixtures, the lighting fixture(s) being connected to the controller so as to be able to receive one or more commands therefrom.

DETAILED DESCRIPTION OF EMBODIMENTS

Figure 1:
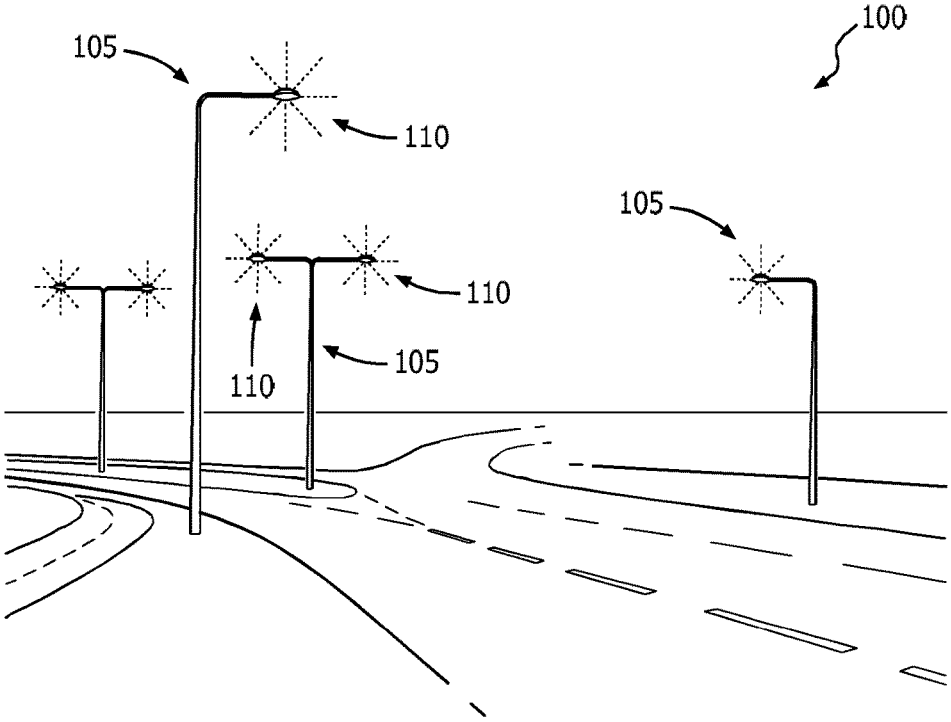
FIG. 1 depicts an external space illuminated by a lighting network in accordance with an embodiment.

Referring to FIG. 1, an outdoor lighting network 100 according to an embodiment of the invention is arranged to illuminate an outdoor space, which in this instance is part of a road network. The outdoor lighting network 100 comprises a plurality of lighting fixtures 105. The outdoor lighting network 100 further comprises a network control system (not shown in FIG. 1; ref 235 in FIG. 2) in communication with the lighting fixtures 105.

Each of the lighting fixtures 105 comprises either one or two lighting units 110, as shown in FIG. 1. Each of the lighting fixtures 105 further comprises a vertical pole which is secured to the ground and which is arranged to support the lighting unit(s) 110 at a certain distance (e.g., four meters) above the ground.

Figure 2:
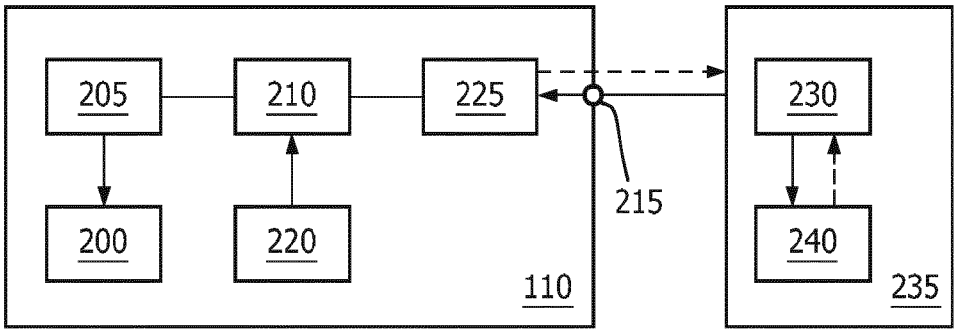
FIG. 2 schematically shows a lighting unit of the lighting network of FIG. 1, the lighting unit being communicably coupled to a controller of said lighting network.

Referring to FIG. 2, each of the lighting units 110 comprises one or more light sources 200, power-supply circuitry 205 (hereinafter, the "driver") which is connected to the light source(s) 200, and a controller 210 (hereinafter, the "lighting controller") which is connected to the driver 205. Each of the lighting units 110 comprises a power input 215 for receiving a supply of electric power; each of the active components of the lighting unit 110 receives its electric power via the power input 215. Each of the lighting units 110 further comprises an optional light sensor module 220 which is connected to the lighting controller 210, and a receiver 225 which is connected to the lighting controller 210. The lighting controller 210 comprises memory (not shown). The receiver 225 is suitable for receiving data from a transmitter 230 of the network control system 235. FIG. 2 includes an arrow representing data and/or commands flowing from the transmitter 230 to the receiver 225 via the power input 215, because embodiments according to FIG. 2 use power-line communication to send data and/or commands from the network control system 235 to the lighting units 110. Suitable methods of sending data and/or commands via power-line communication are disclosed in the applicant's co-pending U.S. patent application, Ser. No. 13/755,122. In various embodiments the receiver 225 may be suitable for receiving data from the transmitter 230 in other ways, e.g. by wireless communication.

In various embodiments, the receiver 225 and the transmitter 230 may be part of respective transceivers, thereby enabling two-way communication between the lighting units 110 and the network control system 235. FIG. 2 includes a dashed arrow representing a backchannel from the lighting unit 110 to the network control system 235.

The network control system 235 further comprises a controller 240 (hereinafter, the "network controller") which is connected to the transmitter 230 and which is configured to generate commands and/or data and send it via the transmitter 230 to the lighting units 110.

In various embodiments, any one or more of the light source(s) 200, the driver 205, the light sensor module 220, the receiver/transceiver 225 and the transmitter/transceiver 230 may be components which are known per se to those of ordinary skill in the art. Therefore these components per se will not be described in any detail herein.

Figure 3:
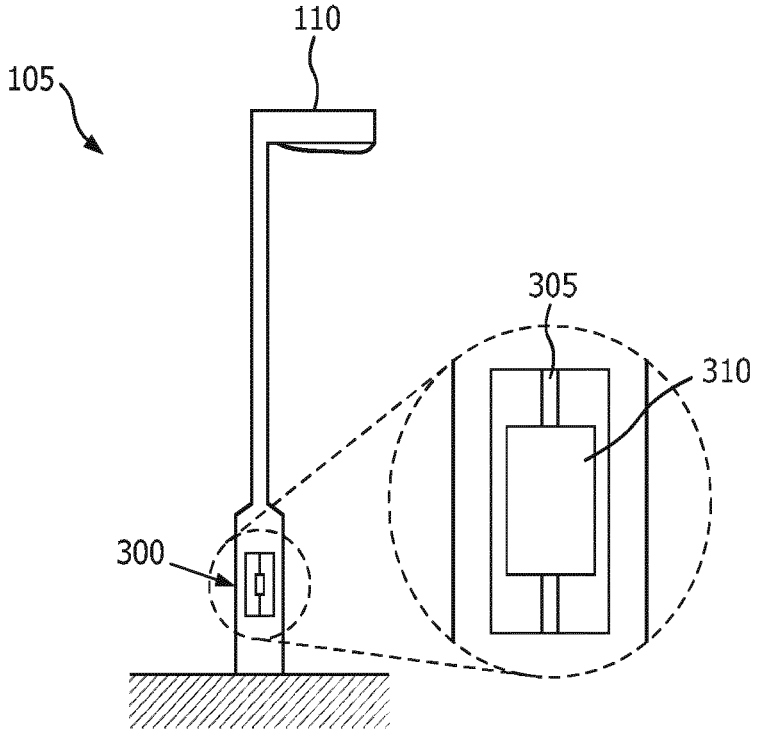
FIG. 3 schematically shows a lighting fixture of the lighting network of FIG. 1, including an interrupter thereof suitable for manually interrupting a supply of electric power to a lighting unit of the lighting fixture.

Referring to FIG. 3, each of the lighting fixtures 105 further comprises an interrupter for manually interrupting the supply of electric power to its lighting unit 110, at an accessible location 300. For example, each of the lighting fixtures 105 may comprise a power line 305 arranged to deliver the supply of electric power to the power input 215 of its lighting unit 110, the power line 305 comprising an interrupter 310 such as a fuse unit in the power line 305 at the accessible location 300. The fuse unit 310 is configured to permit a fuse to be manually removed, and replaced, thereby permitting a commissioning engineer or other personnel (hereinafter, referred to as the "Engineer" for convenience) to reversibly break the circuit arranged to provide the supply of electric power to the lighting unit 110. In various embodiments, the power line 305 may comprise a switch, a circuit breaker or the like, instead of or as well as the fuse unit 310, in order that the Engineer may reversibly break the circuit arranged to provide the supply of electric power to the lighting unit 110.

Figure 4:
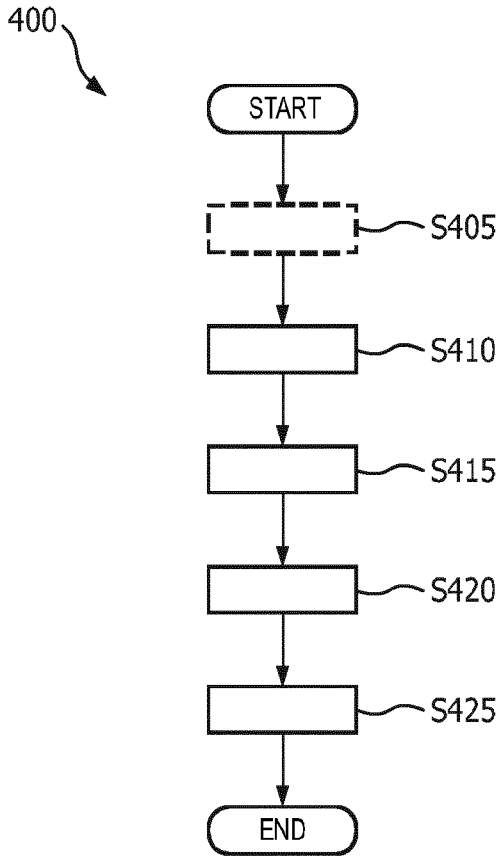
FIG. 4 schematically shows a method of configuring a plurality of the lighting units of FIG. 2, so that each is assigned to a desired logical group.

Having described the outdoor lighting network 100, a method 400 of configuring it will now be described with reference to FIG. 4. In the following description, it is assumed that the outdoor lighting network 100 has already been installed (in a conventional manner which need not be described herein). For convenience the method will be described for only two of lighting units 110, and two logical groups. It will be appreciated that in practical embodiments the outdoor lighting network 100 will include many lighting units 110, each of which can be configured using the following method. Similarly, there is no limit to the number of logical groups with which the described method can be applied.

In various embodiments, and with reference to FIG. 4, the method 400 proceeds generally as follows.

First, optionally, a join-first-group command is broadcast (at step S405) from the controller 240 to at least a first lighting unit 110 and a second lighting unit 110. The join-first-group command is arranged to cause any suitable lighting unit which receives it to join a first logical group. Thus, broadcasting the join-first-group command causes the first and second lighting units to join the first logical group. Broadcasting the join-first-group command is effected by the Engineer, e.g. in person at the controller 240 by pressing an appropriate button thereon, or remotely via a portable control device configured to communicate with the controller 240. This step may be omitted if, e.g., the lighting units 110 have a (factory-set) default configuration whereby they are already members of the first logical group.

Next, it is determined (at step S410) that the first lighting unit 110 should remain a member of the first logical group, and that the second lighting unit 110 should switch to a second logical group. The Engineer may determine this by, for example, consulting a lighting plan which indicates which of the lighting units 110 should be assigned to which logical group.

Next, a supply of electric power to the first lighting unit 110 is interrupted (at step S415). The first lighting unit 110 is incapable of receiving a command from the controller 240 while the supply of electric power is interrupted. Interrupting the supply of electric power to the first lighting unit 110 may comprise reversibly breaking a circuit arranged to provide the supply of electric power thereto, at an accessible location on or in the pole to which the lighting unit 110 is attached. For example, the Engineer may remove a panel which is secured to the pole at the accessible location 300, thereby revealing the fuse unit 310. Then, the Engineer may remove the fuse from the fuse unit 310, thereby interrupting the supply of electric power to the first lighting unit 110.

Next, a join-second-group command is broadcast (at step S420) from the controller to at least the first and second lighting units, i.e. while the supply of electric power to the first lighting unit 110 is interrupted. The join-second-group command is arranged to cause any suitable lighting unit which receives it to join the second logical group. Thus, broadcasting the join-second-group command causes the second (and not the first) lighting unit 110 to join the second logical group. The Engineer may effect this broadcasting in a similar manner to the broadcasting in step 405.

Then, the supply of electric power to the first lighting unit 110 is resumed (at step S425). As a result, the first lighting unit 110 becomes operable to receive and react to commands from the controller 240. The Engineer may resume the supply of electric power by reversing what he did in step S415, e.g. he may replace the fuse in fuse unit 310.

As a result of the above-described method 400, the lighting units 110 are configured such that each is assigned to a desired on of a plurality of logical groups. Thereafter, the controller 240 may broadcast to the lighting units 110 a lighting-related command which identifies a logical group for which the lighting-related command is intended; only lighting units 110 assigned to the identified logical group will react to the lighting-related command. For instance, the first logical group may be an Ambient Light Point (AMP) group and the second logical group may be a Traffic Attention Point (TAP) group. The TAP group may include any lighting units 110 at locations in a road network where certain traffic maneuvers are required, e.g. crossings, exits etc. An example of a lighting-related command is a dim-down command, which when intended for AMP lighting units 110 may cause "deeper" dimming than when intended for TMP lighting units 110; the deeper dimming may enable substantial energy savings.

The foregoing description was given by way of example only. Those of ordinary skill in the art will appreciate numerous modifications and alternative embodiments which fall within the scope of the claims herein. For example, the foregoing description discusses the light source 200. The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radio luminescent sources, and luminescent polymers.

The foregoing description discusses the light unit 110. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s).

The foregoing description discusses the lighting controller 210 and the network controller 240. The term "controller" is used herein generally to describe various apparatus relating to the operation of one or more light sources or other devices. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs). In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein.

The terms "transmitter", "receiver" and "transceiver" are used herein in a generic sense to refer to any type of apparatus suitable for, respectively, transmitting a signal, receiving a signal and both transmitting a signal and receiving signals.

The foregoing description discusses the lighting fixture 110. The term "lighting fixture" is used herein to refer to an implementation or arrangement of one or more lighting units in a particular form factor, assembly, or package.

The foregoing description discusses the outdoor lighting network 100. The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection).

It should be appreciated that all combinations of the foregoing concepts (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

The invention claimed is:

1. A method of configuring a plurality of installed lighting units, the method comprising:

connecting the plurality of installed lighting units to a first logical group;

determining that a first installed lighting unit of the plurality of installed lighting units should remain a member of the first logical group, and that a second installed lighting unit of the plurality of installed lighting units should switch to a second logical group;

interrupting a supply of electric power to the first installed lighting unit whereby it is incapable of receiving commands from a controller;

broadcasting, from the controller, to at least the first and second installed lighting units, a command arranged to cause any suitable lighting unit which receives it to join the second logical group, thereby causing the second installed lighting unit to switch to the second logical group; and resuming the supply of electric power to the first installed lighting unit whereby it becomes operable to receive the commands from the controller.

2. The method of claim 1 in which the first installed lighting unit is mounted on a pole, and in which interrupting the supply of electric power thereto comprises reversibly breaking a circuit arranged to provide the supply of electric power to the lighting unit, at an accessible location on or in the pole.

3. The method of claim 2 in which reversibly breaking the circuit comprises at least one of: operating a switch at the accessible location; operating a circuit breaker at the accessible location; and removing a fuse at the accessible location.

4. The method of claim 1, further comprising broadcasting from the controller to at least the first and second installed lighting units, before interrupting the supply of electric power to the first installed lighting unit, another command arranged to cause any suitable lighting unit which receives it to join the first logical group, thereby causing the first and second installed lighting units to join the first logical group.

5. The method of claim 4, further comprising determining that there is a minority logical group for the plurality of installed lighting units, and selecting the minority logical group as said first logical group.

6. The method of claim 1, in which said broadcasting comprises broadcasting the command via power line communication.

7. A lighting network having one or more lighting units, the light network comprising:

a controller, the controller being operable to broadcast a first command, the first command being arranged to cause any powered lighting unit of one or more lighting units which receive the first command to join a first logical group, the controller being further operable to broadcast a second command, the second command being arranged to cause any powered lighting unit of one or more lighting units which receives the second command to join a second logical group;

wherein the one or more lighting units are configured to be a member of the first logical group, receive the second command, arranged to cause any powered lighting unit which receives the second command to join the second logical group, and switch from the first logical group to the second logical group in response to receiving said second command;

an interrupter suitable for interrupting a supply of electric power to the one or more lighting units such that the one or more lighting units is incapable of receiving said first or second commands.

8. The lighting network of claim 7, wherein the interrupter is provided at an accessible location on or in the lighting fixture.

9. The lighting network of claim 7, wherein the interrupter comprises at least one of: a switch; a circuit breaker; and a fuse.

10. The lighting network of claim 7, being further operable to broadcast at least one of the first command and the second command via power line communication.

11. A lighting network having a plurality of lighting units connected to a first logical group, the light network comprising:

a controller configured to receive input indicating that a first installed lighting unit of the plurality of installed lighting units should remain a member of the first logical group, and that a second installed lighting unit of the plurality of installed lighting units should switch to a second logical group;

an interrupter suitable for interrupting a supply of electric power to the one or more lighting unit of the plurality of lighting units;

wherein the controller being operable to broadcast a command, the command being arranged to cause any powered lighting unit of plurality of lighting units which receives the command to join the second logical group.

* * * * *